US009255677B2

(12) United States Patent
Pickard et al.

(10) Patent No.: US 9,255,677 B2
(45) Date of Patent: Feb. 9, 2016

(54) MULTI-TIERED LIGHTING SYSTEM

(75) Inventors: Paul Pickard, Morrisville, NC (US); John Wesley Durkee, Raleigh, NC (US)

(73) Assignee: Cree, Inc., Durham, NC (US)

( * ) Notice: Subject to any disclaimer, the term of this patent is extended or adjusted under 35 U.S.C. 154(b) by 568 days.

(21) Appl. No.: 13/609,886

(22) Filed: Sep. 11, 2012

(65) Prior Publication Data

US 2014/0071677 A1 Mar. 13, 2014

(51) Int. Cl.

| | |
|---|---|
| ***F21S 8/00*** | (2006.01) |
| ***F21S 8/08*** | (2006.01) |
| ***H05B 33/08*** | (2006.01) |
| *F21Y 101/02* | (2006.01) |
| *F21Y 105/00* | (2006.01) |

(52) U.S. Cl.

CPC ..... *F21S 8/086* (2013.01); *H05B 33/0842* (2013.01); *F21Y 2101/02* (2013.01); *F21Y 2105/001* (2013.01)

(58) Field of Classification Search

CPC ..... F21S 8/085; F21S 8/086; F21S 8/088; F21V 21/116; F21W 2131/10; F21W 2131/103; F21W 2131/105; H05B 33/0842; F21Y 2105/001; F21Y 2101/02

USPC ..... 362/249.01, 249.02, 414, 431

See application file for complete search history.

(56) References Cited

U.S. PATENT DOCUMENTS

| | | | | |
|---|---|---|---|---|
| 7,268,508 | B2 * | 9/2007 | Caillaud et al. | 318/379 |
| 2006/0181869 | A1 * | 8/2006 | Gordin et al. | 362/153.1 |
| 2006/0198145 | A1 * | 9/2006 | Gordin | 362/257 |
| 2006/0245189 | A1 * | 11/2006 | Gordin | 362/234 |
| 2009/0129081 | A1 * | 5/2009 | Gordin | 362/235 |
| 2009/0135411 | A1 * | 5/2009 | Gordin | 356/138 |
| 2010/0321930 | A1 * | 12/2010 | Watanabe et al. | 362/184 |

* cited by examiner

*Primary Examiner* — Thomas M Sember

(74) *Attorney, Agent, or Firm* — Withrow & Terranova, P.L.L.C.

(57) ABSTRACT

The present disclosure relates to a multi-tiered lighting system that has a pole and at least two light sources. A first light source is mounted to the pole at a first height, and a second light source is mounted to the pole at a second height that is substantially different than the first height. The first light source is configured to project a first beam of light that primarily lights up a first portion of a target coverage area, and the second light source is configured to project a beam of light that primarily lights up a second portion of the target coverage area, which is different from the first target coverage area. The first beam of light may spill onto the second target area, and the second beam of light may spill onto the first target area.

27 Claims, 14 Drawing Sheets

TYPE V

MULTI-TIERED LIGHTING SYSTEM

FIELD OF THE DISCLOSURE

The present disclosure relates to a lighting system and in particular to a multi-tiered lighting system.

BACKGROUND

As illustrated in FIG. 1, a traditional outdoor luminaire 10, or lighting fixture, generally includes a pole 12, a light source 14, and perhaps a mounting arm 16 that is used to affix the light source 14 at or near the top of the pole 12. Conventional light sources 14 employ a metal halide, high-pressure sodium, plasma, and induction technology. These types of light sources 14 do not render colors well and many generate high amounts of heat relative to the amount of light produced. Further, luminaires 10 that employ these types of light sources 14 do not evenly light up the target coverage area, such as a roadway or parking lot.

Because the intensity of light falls off in a manner inversely proportional to the square of the distance traveled, higher intensity light is required to equally illuminate longer distances. Assuming the light source 14 is mounted at a height x above the target coverage area, the distance from the light source 14 to the target coverage area is 1.15× at 30 degrees and 2× at 60 degrees. To maintain a relatively uniform illumination of the target coverage area, the light source 14 would have to project 54% more light at 30 degrees than it would directly below the light source 14 (0 degrees). At 60 degrees, the light source 14 would have to project 700% more light than it would directly below the light source 14. Unfortunately, these types of light sources 14 are not only not capable of projecting light in this manner, they often are not capable of projecting the same amount of light at higher angles than they are at lower angles. As such, a substantially uniformly lit target coverage area is virtually impossible with traditional luminaires 10.

Another issue with traditional luminaires 10 is their expense, and in particular the expense of the poles 12. Given the heights of the poles 12 and the mass and surface area associated with the conventional light sources 14 and mounting arms 16, the poles 12 must be substantial to handle normal environmental forces, such as wind, snow and ice. Wind is particularly problematic because the lateral forces imparted by the wind on the light source 14 are effectively multiplied by the mass of the light source 14 and the height of the pole 12 to create rather large moments $M_1$ at the base of the pole 12. Given these substantial forces, the poles 12 must be very robust, and very robust poles 12 are expensive. In most scenarios, the cost of the poles 12 greatly exceeds that of the light sources 14.

SUMMARY

The present disclosure relates to a multi-tiered lighting system that has a pole and at least two light sources. A first light source is mounted to the pole at a first height, and a second light source is mounted to the pole at a second height that is substantially different than the first height. The first light source is configured to project a first beam of light that primarily lights up a first portion of a target coverage area, and the second light source is configured to project a beam of light that primarily lights up a second portion of the target coverage area, which is different from the first target coverage area. The first beam of light may spill onto the second target area, and the second beam of light may spill onto the first target area.

The first and second light sources may be LED-based light sources, which are designed to provide white light at a desired intensity, color temperature, and color rendering capability. In one embodiment, each light source is associated with AC-DC circuitry that converts an AC signal to at least one rectified signal and DC-DC circuitry that is capable of converting the rectified signal into the requisite drive signals for driving the various LEDs of the light source. In a second embodiment, each of the first and second light sources have DC-DC circuitry, but share common AC-DC circuitry. In a third embodiment, the first and second light sources both share common AC-DC circuitry and DC-DC circuitry.

The LED-based light sources may be designed to be much more efficient than conventional metal halide or high pressure sodium light sources. The LED-based light sources may more accurately render colors and last substantially longer than their conventional counterparts. By employing multiple LED-based light sources at different heights on the pole, the target coverage area may be more uniformly covered by having the different light sources directed to covering the different portions of the target coverage area.

With a multi-tiered approach, smaller and lighter LED-based light sources may be used to reduce the moment applied to the pole. Relative to a conventional lighting system, the required lumen output of a relatively large and high lumen output conventional light source is divided into at least two smaller and lower lumen output light sources. As such, a first relatively low mass light source may be used at the top of the pole, and one or more relatively low mass light sources may be used at substantially lower points on the pole. By lowering the mass of the light sources and the mounting heights of one or more of the light sources, the moment applied to the pole is significantly reduced. As such, the structural integrity of the pole, and more importantly, the cost of the pole, may be reduced proportionately.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 6A:
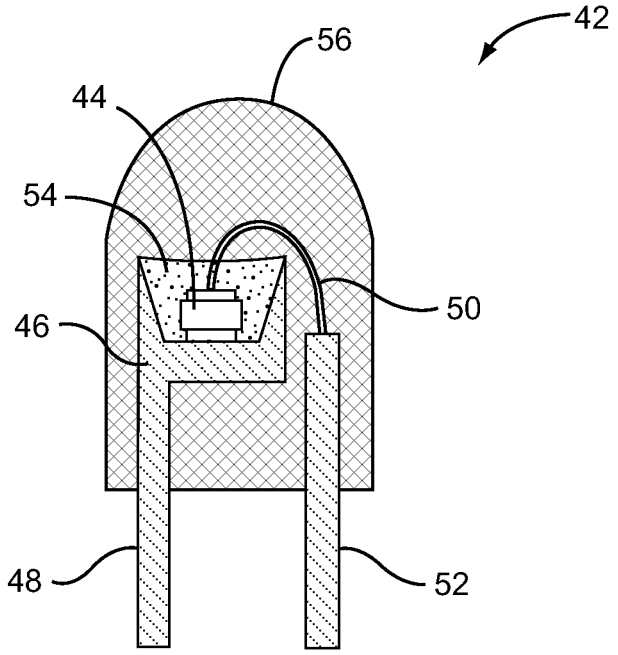
Figure 6B:
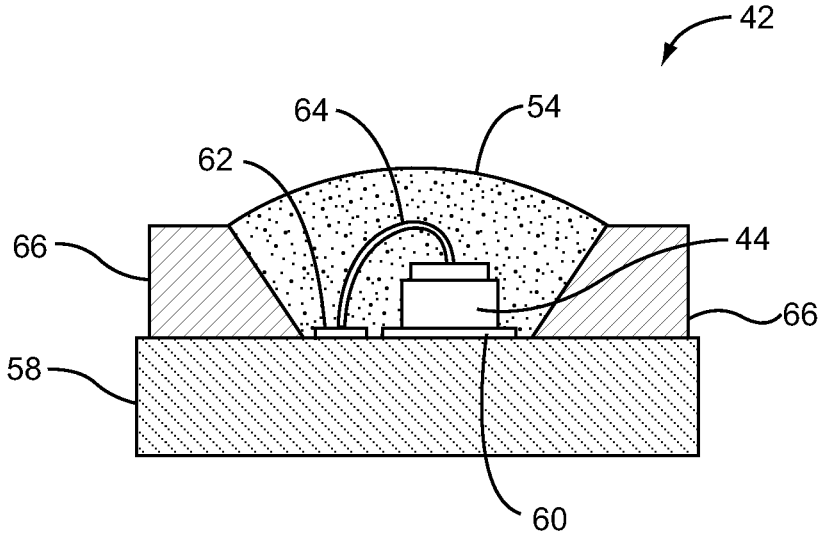

FIGS. 6A and 6B provide exemplary LEDs according to the present disclosure.

Figure 7:
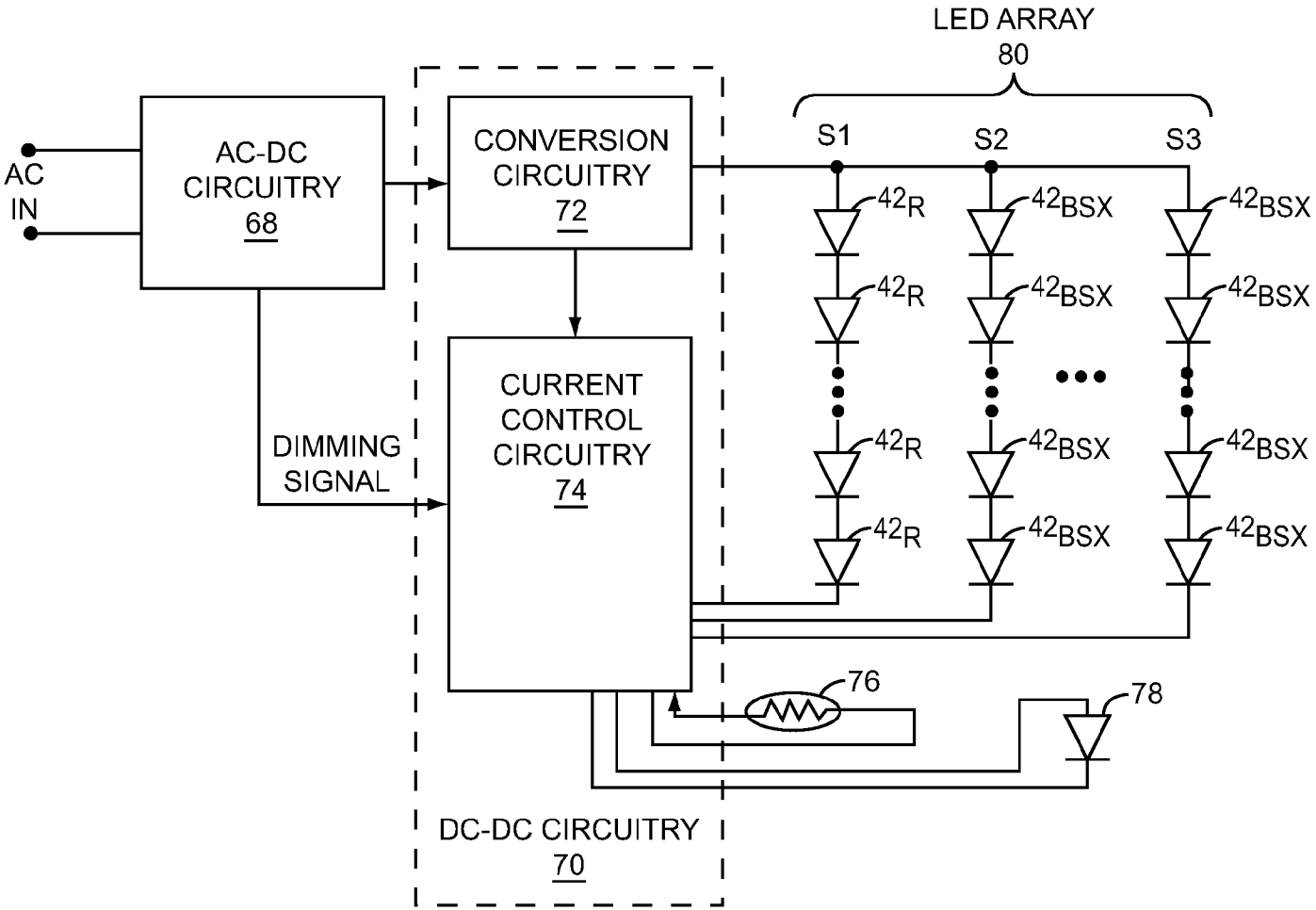

FIG. 7 is a block diagram of electronics used for driving an array of LEDs according to one embodiment of the present disclosure.

Figure 8A:
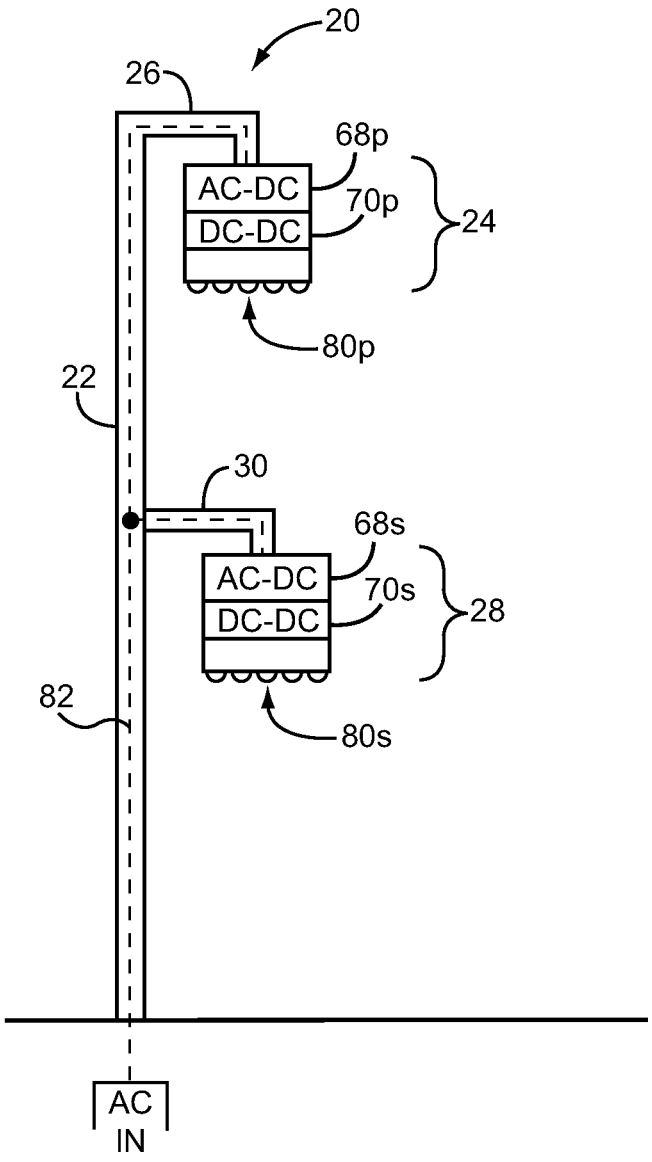

FIG. 8A illustrates distribution of AC-DC and DC-DC circuitry according to a first embodiment of the present disclosure.

Figure 8B:
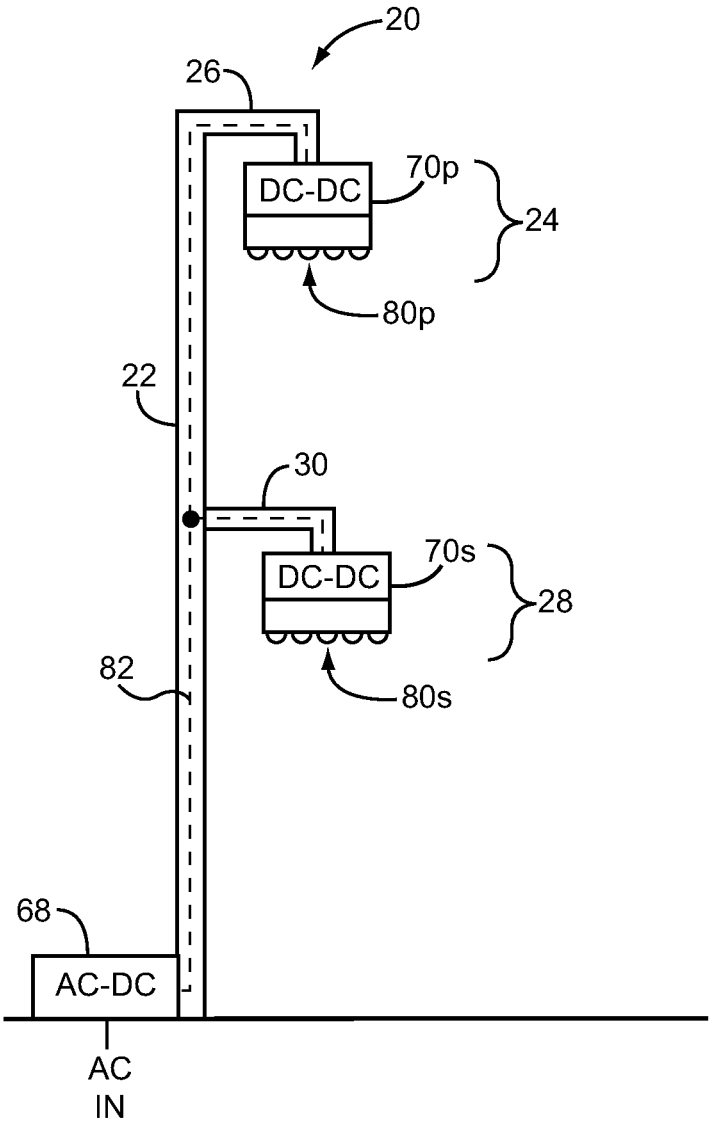

FIG. 8B illustrates distribution of AC-DC and DC-DC circuitry according to a second embodiment of the present disclosure.

Figure 8C:
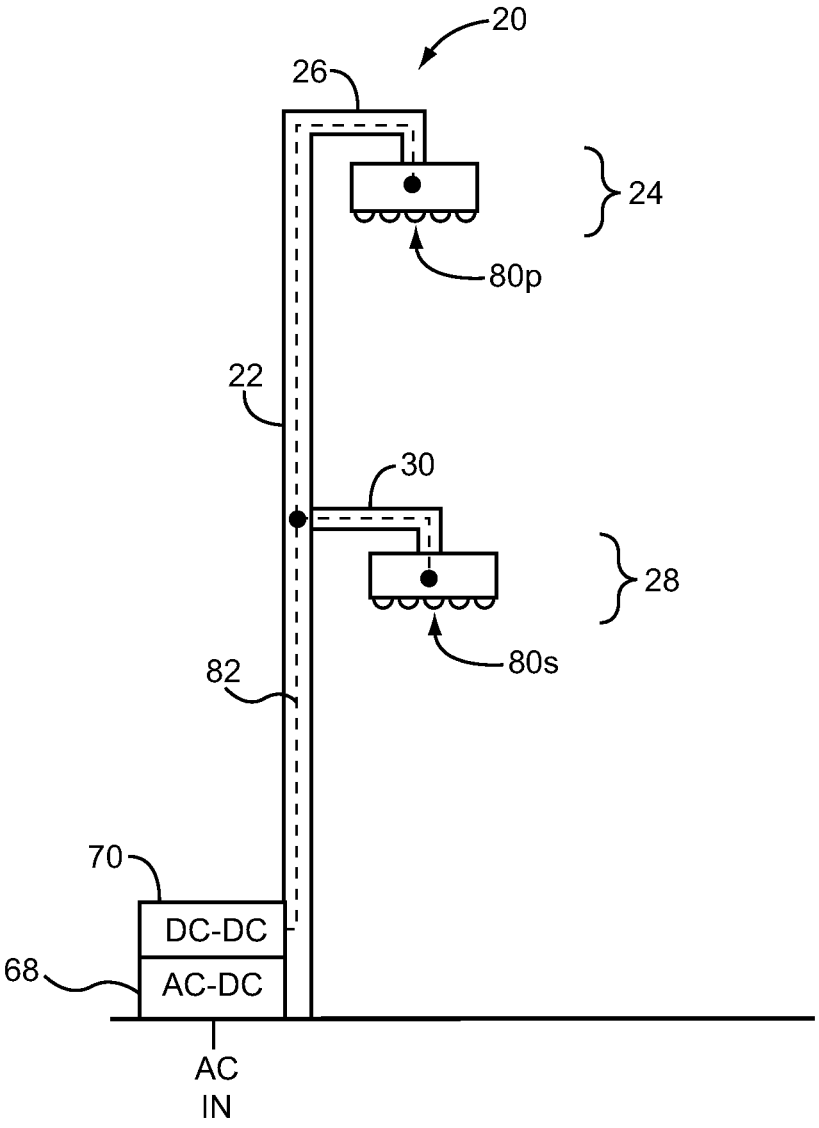

FIG. 8C illustrates distribution of AC-DC and DC-DC circuitry according to a third embodiment of the present disclosure.

Figure 8D:
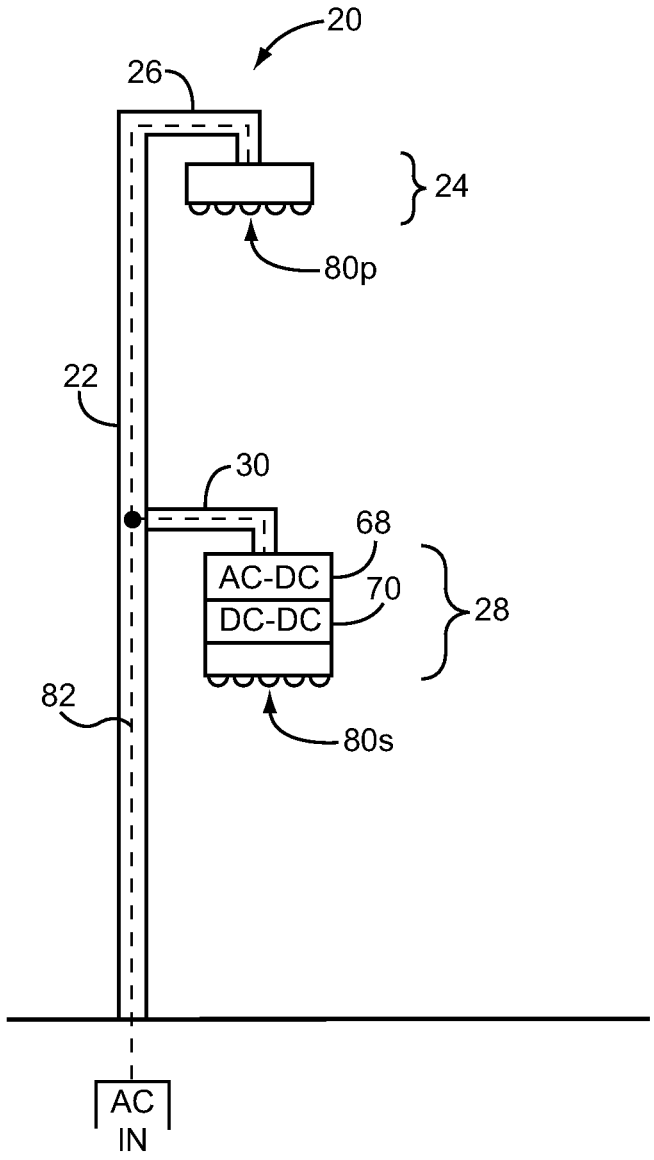

FIG. 8D illustrates distribution of AC-DC and DC-DC circuitry according to a fourth embodiment of the present disclosure.

FIGS. 9A-9D illustrate configurations of the primary and secondary light sources according to various embodiments of the present disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 1:
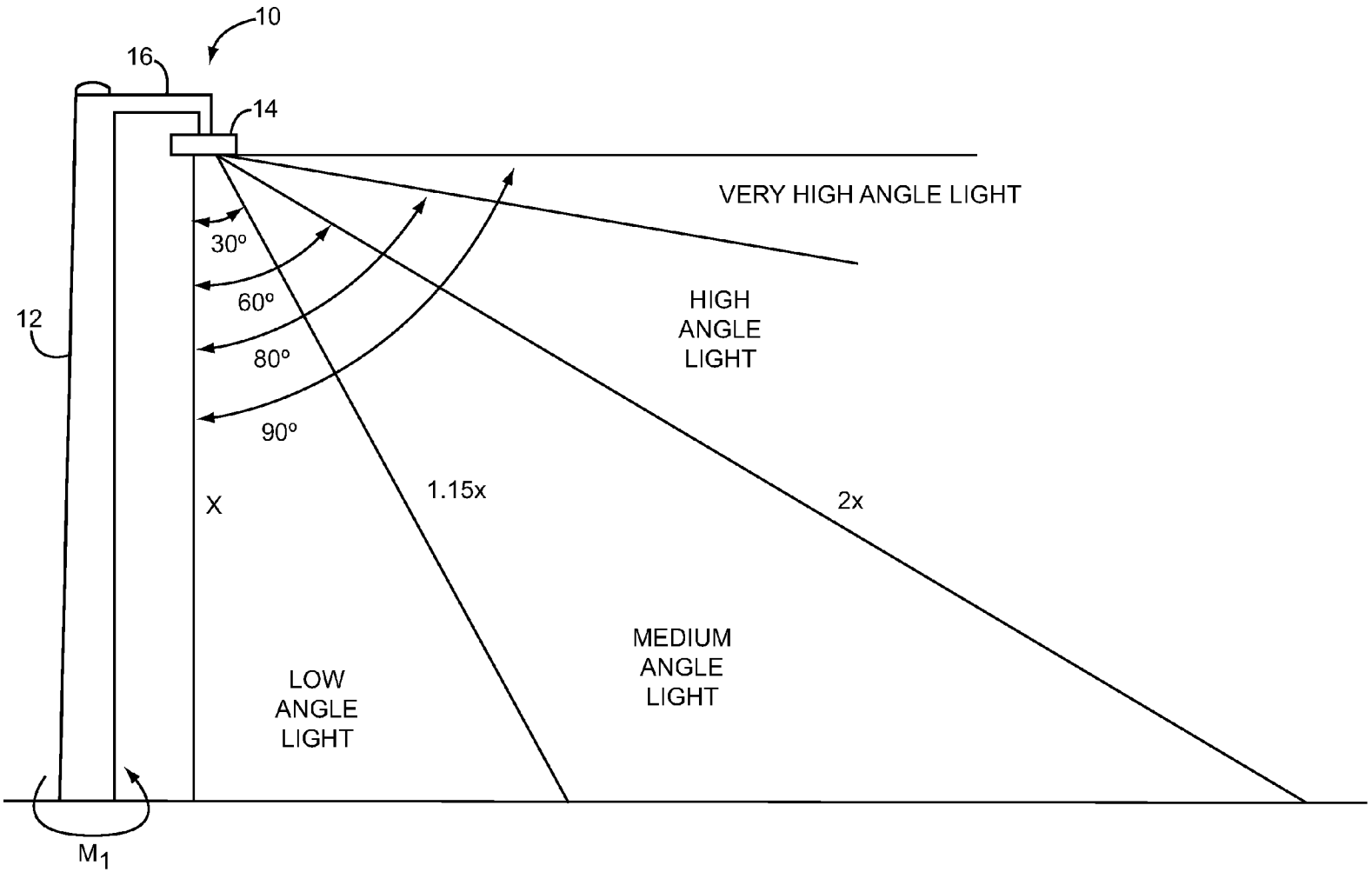
FIG. 1 RELATED ART
FIG. 1 illustrates a conventional luminaire according to the related art.
Figure 2:
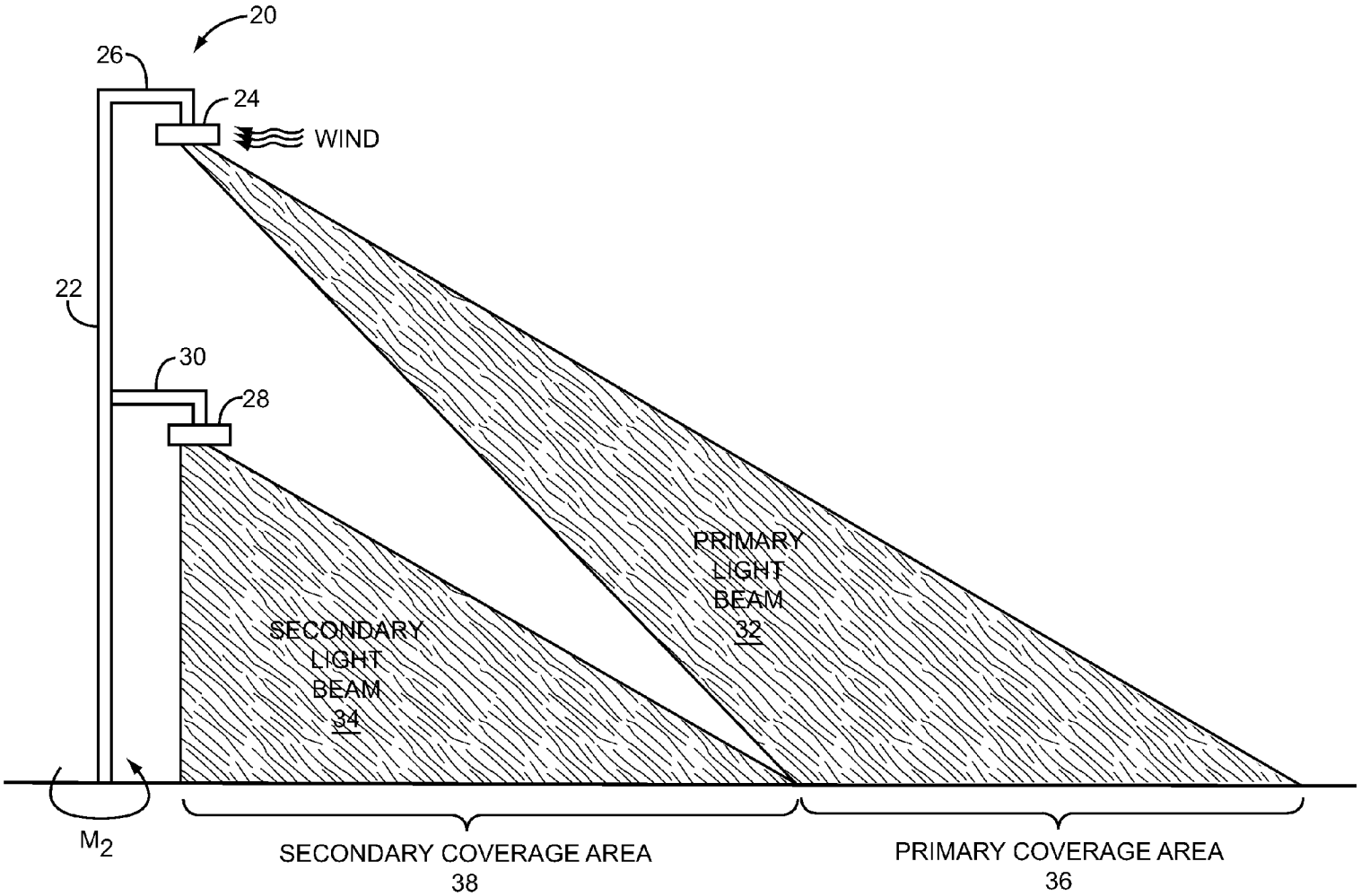
FIG. 2 illustrates a luminaire according to one embodiment of the present disclosure.
Figure 3A:
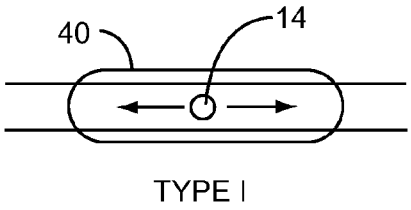
FIGS. 3A-3E illustrate various lateral light distribution types as defined by IESNA.
Figure 3B:
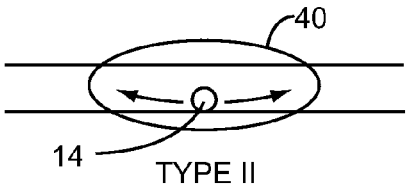
Figure 3C:
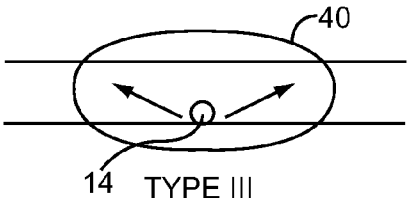
Figure 3D:
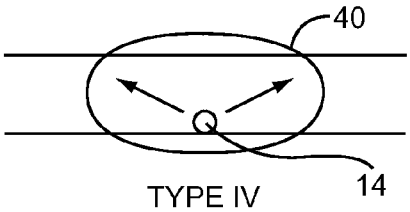
Figure 3E:
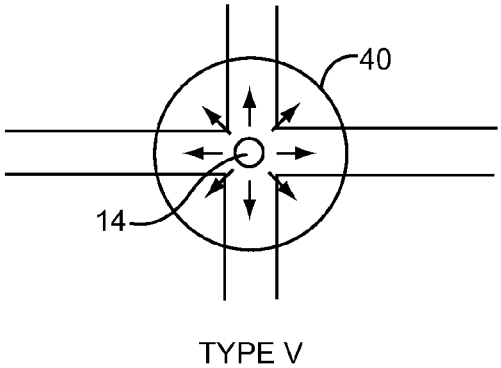

As illustrated in FIG. 2, the present disclosure relates to a multi-tiered luminaire 20 that has a pole 22 and at least two light sources. A primary light source 24 is shown mounted to the pole 22 at a first height via a primary mounting arm 26, and the secondary light source 28 is mounted to the pole 22 via a secondary mounting arm 30. The terms primary and secondary are only used to differentiate the different light sources 24, 28, and are not intended to indicate that one light source 24, 28 is more or less important than the other.

The light sources 24, 28 are mounted at substantially different heights on the pole 22, and for reference, the first height of the primary light source 24 is substantially higher than the second height of the secondary light source 28. The primary light source 24 is configured to project a primary light beam that primarily lights up a primary coverage area 36 of a target coverage area, and the secondary light source 28 is configured to project a secondary light beam that primarily lights up a secondary coverage area 38 of the target coverage area. The secondary coverage area 38 is different from the primary coverage area 36. The primary light beam 32 may, and will most likely, spill onto the secondary coverage area 38, and the secondary light beam 34 may spill onto the primary coverage area 36.

The primary and secondary light sources 24, 28 are solid-state light sources, such as LED-based light sources, which are designed to provide white light at a desired intensity, color temperature, and color rendering capability. LED-based light sources may be designed to be much more efficient than conventional metal halide or high-pressure sodium light sources. The LED-based light sources may more accurately render colors and last substantially longer than their conventional counterparts. By employing the LED-based primary and secondary light sources 24, 28 at different heights on the pole 22, the overall target coverage area may be more uniformly covered by having the different light sources directed to covering the different portions of the target coverage area.

With a multi-tiered approach, smaller and lighter LED-based light sources 24, 28 may be used to reduce the moment applied to the pole 22. Relative to a conventional lighting system, the required lumen output of a relatively large and high lumen output conventional light source is divided into at least two smaller and lower lumen output light sources. As such, a relatively low mass primary light source 24 may be mounted at the top of the pole 22, and one or more relatively low mass secondary light sources 28 may be used at substantially lower points on the pole 22. By lowering the mass of the primary and secondary light sources 24, 28 and lowering the mounting height of the secondary light source 28, the moment $M_2$ applied to the pole 22 is significantly reduced. As such, the structural integrity of the pole 22, and thus, the cost of the pole 22, may be reduced proportionately.

Conventional outdoor luminaires 10 that employ a single light source 14 at or near the top of the pole 12 may be classified based on light distribution traits. Light distribution is controlled based on the several factors, including the range and shape of the dispersion pattern provided by the light source 14. For roadway applications, the Illuminating Engineering Society of North America (IESNA) defines different lighting distributions using lateral light distribution and vertical light distribution criteria. The lateral light distribution criteria characterize the shape of the light distribution pattern and the position of the light source 14 relative to the light distribution pattern.

FIGS. 3A through 3E illustrate the five different lateral light distribution types (Types I, II, III, IV, and V), as defined by the IESNA, for conventional luminaires 10. For each light distribution type, the light source 14 is shown relative to the corresponding light distribution pattern 40.

Type I illustrates an elongated light distribution pattern 40, wherein the light source 14 of the conventional luminaire 10 is approximately centered within the light distribution pattern 40. Types II-IV provide varying oval-shaped light distribution patterns 40, as well as varying placements for the light source 14 of the conventional luminaire 10. Type V provides a substantially circular light distribution pattern, wherein the light source 14 of the conventional luminaire 10 is centered within the light distribution pattern 40.

The vertical light distribution of the luminaire 10 is classified as either short, medium, or long. The vertical light distribution types (short, medium, or long) correspond to the amount of throw relative to the light source 14. As such, for any given type of lateral light distribution, a medium vertical distribution would provide more coverage along a road than a short distribution. As such, use of a medium vertical distribution light source 14 would allow greater spacing between poles to light the road than a luminaire 10 that employs a light source 14 using a short vertical light distribution.

Figure 4A:
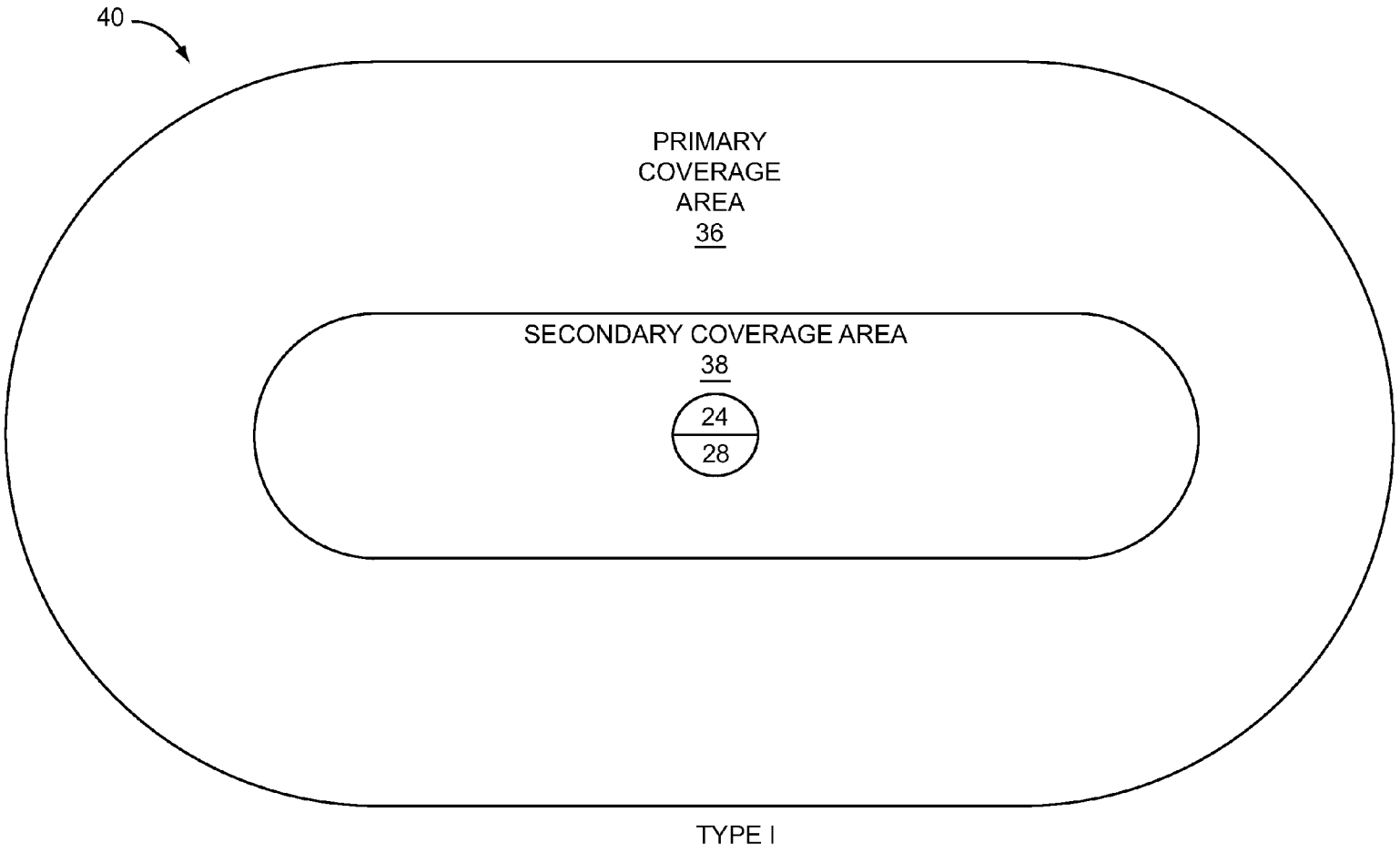
FIGS. 4A-4C illustrate various lateral light distribution types as provided by various embodiments of the present disclosure.
Figure 4B:
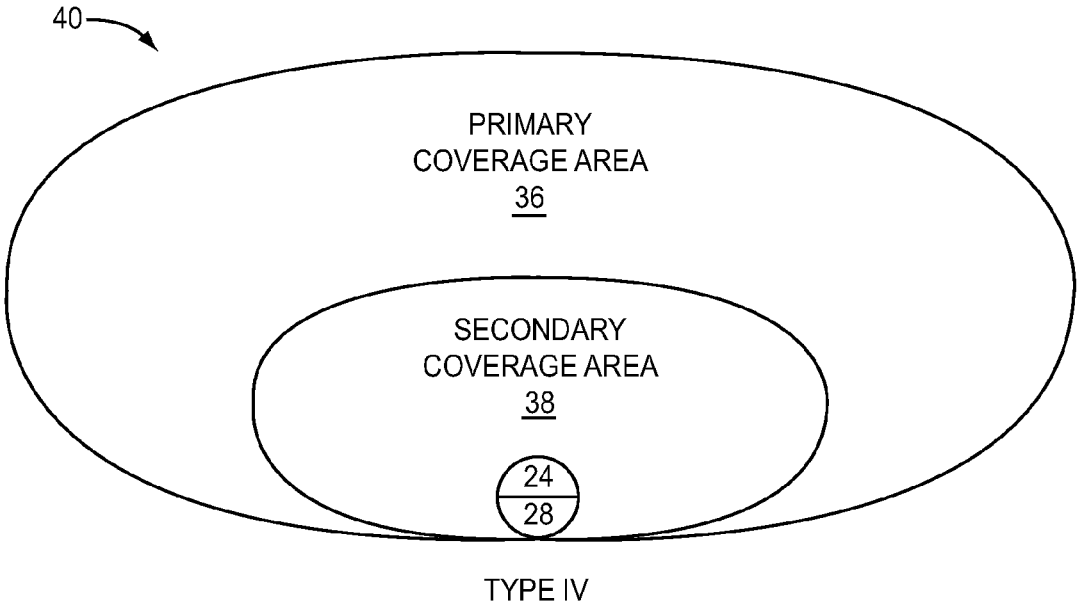
Figure 4C:
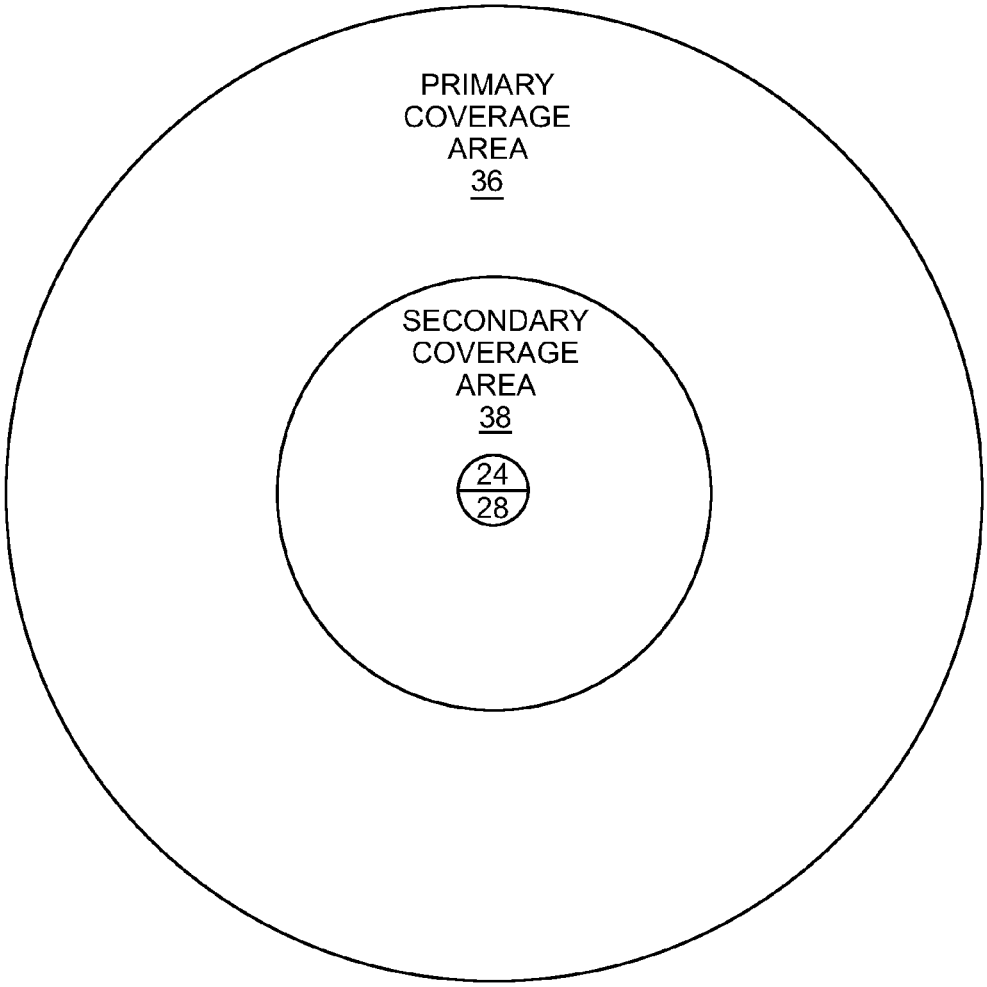

The multi-tiered luminaire 20 of the present disclosure may also be characterized by traditional light distribution criteria, such as those defined by the IESNA. With reference to FIGS. 4A-4C, the light distribution patterns 40 for three types of lateral light distributions are provided. In FIG. 4A, a type I lateral light distribution is provided by a luminaire 20 having a primary light source 24 mounted at or near the top of the pole 22, and a secondary light source 28 mounted on the pole 22 substantially below the primary light source 24, such as illustrated in FIG. 2. In this configuration, the lower, secondary light source 28 is configured to illuminate the elongated secondary coverage area 38, wherein the primary light source 24 is configured to illuminate the primary coverage area 36. In one embodiment, the primary light source 24 is configured to produce a light pattern that has an interior void, which is effectively filled by the light distribution pattern of the secondary light source 28. A type IV lateral light distribution pattern is shown in FIG. 4B, wherein the upper, primary light source 24 provides an oval light distribution pattern that covers the primary coverage area 36, and the lower, secondary light source 28 provides a light distribution pattern that fills in the secondary coverage area 38. FIG. 4C illustrates a type V lateral distribution pattern, wherein the upper, primary light source 24 provides an annular light distribution pattern to fill the primary coverage area 36, wherein the lower, secondary light source 28 provides a circular light distribution pattern that fills the opening within the primary coverage area 36, which corresponds to the secondary coverage area 38.

Figure 5:
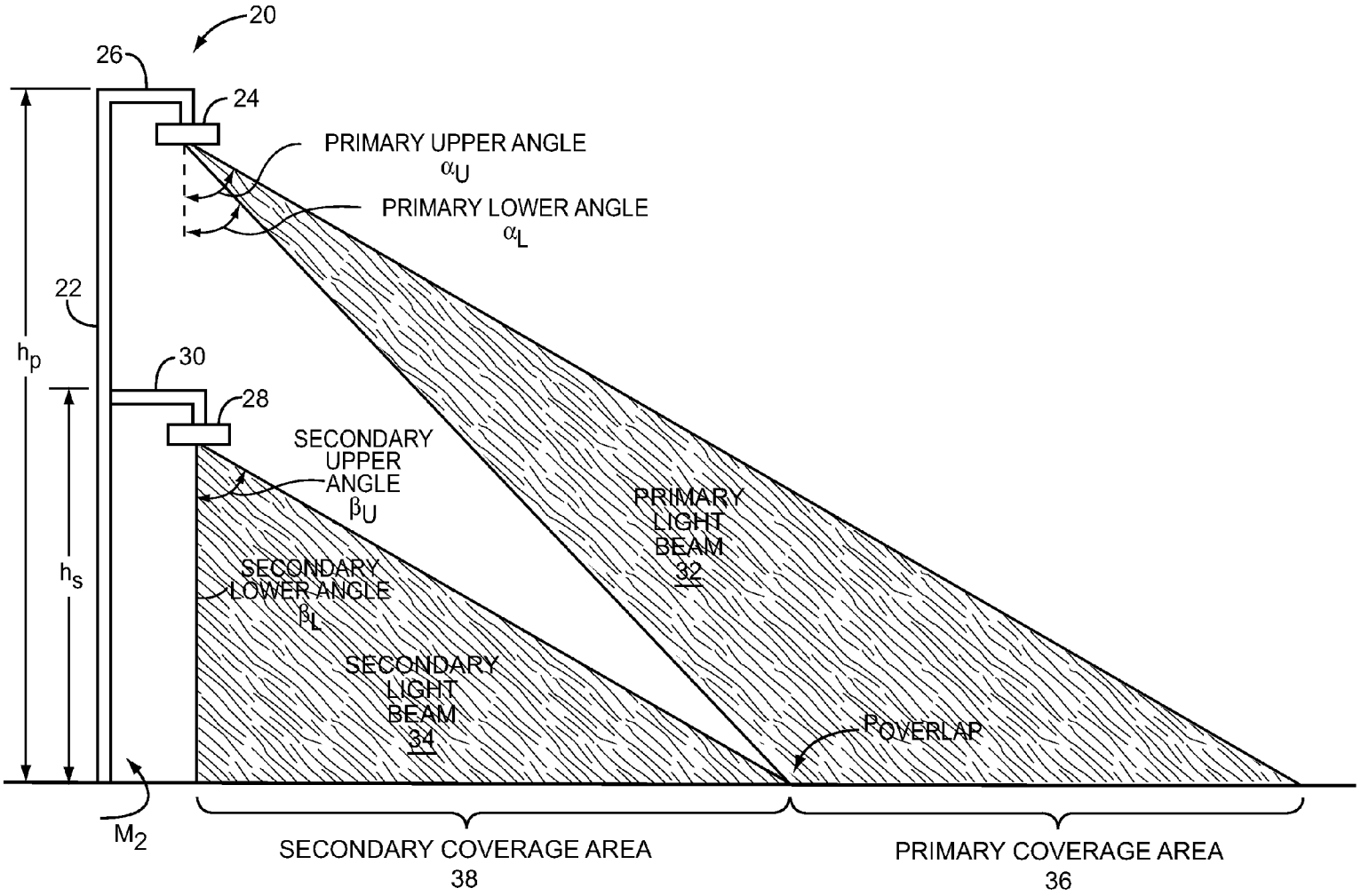
FIG. 5 illustrates mounting heights and light beam angles according to one embodiment of the present disclosure.

With reference to FIG. 5, a luminaire 20 is illustrated to show a primary mounting height $h_p$ of the primary light source 24 and a secondary mounting height $h_s$ of the secondary light source 28. Correspondingly, the primary upper angle $\alpha_U$ and primary lower angle $\alpha_L$ for the primary light beam 32, which is provided by the primary light source 24, is shown along with the secondary upper angle $\beta_U$ and the secondary lower angle $\beta_L$ of the secondary light beam 34 provided by the secondary light source 28. The primary upper angle $\alpha_U$ and the primary lower angle $\alpha_L$ represent the effective upper and lower angles of the primary light beam 32, and based on the primary height $h_p$ will dictate the primary coverage area 36, which will be illuminated by the primary light source 24. The primary upper angle $\alpha_U$ and the primary lower angle $\alpha_L$ are relative to nadir, which effectively corresponds to a vertical line between the primary light source 24 or the secondary light source 28 and the ground. Accordingly, the secondary lower angle $\beta_L$ is shown as being zero, and thus, corresponds to nadir. The secondary light beam 34 may provide a coverage area between nadir (secondary lower angle $\beta_L$) and the secondary upper angle $\beta_U$ to provide coverage for the secondary coverage area 38.

There is an overlap point $P_{overlap}$ at the intersection of the secondary coverage area 38 and the primary coverage area 36. In select embodiments, the primary and secondary light sources 24, 28 are configured such that the intensity of light at the overlap point $P_{overlap}$ from the primary light source 24 along the primary lower angle $\alpha_L$ is approximately 50% of that in the center of the primary beam 32, and the intensity of the light at the overlap point $P_{overlap}$ from the secondary light source 28 along the secondary upper angle $\beta_U$ is 50% of that in the center of the secondary light beam 34. As such, the light spilling into the primary coverage area 36 from the secondary light source 28 will help to reinforce the lighting provided by the primary light source 24 in the primary coverage area 36 near the overlap point, and vice versa. In select embodiments, the difference between the primary upper angle $\alpha_U$ and the primary lower angle $\alpha_L$ corresponds to the beam angle for the primary light beam 32, and the difference between the secondary upper angle $\beta_U$ and the secondary lower angle $\beta_L$ corresponds to the beam angle of the secondary light beam 34.

The following Table I provides various configurations for the luminaire 20 according to the present disclosure. The table includes configurations with different lateral and vertical distribution types. To define the relative heights of the primary light source 24 relative to the secondary light source 28, an exemplary secondary mounting height ratio is provided. The secondary mounting height ratio is a ratio of the secondary mounting height $h_s$ divided by the primary mounting height $h_p$ ($h_s/h_p$). Accordingly, a luminaire 20 with a type V lateral distribution and a medium vertical distribution will have a secondary mounting height $h_s$ for the secondary light source 28 that is 0.6 times the primary mounting height $h_p$ of the primary light source 24. If the primary mounting height $h_p$ is 20 feet, the secondary mounting height $h_s$ would be 12 feet (20*0.6). Preferably, the primary upper angle $\alpha_U$ for the primary light beam 32 is set not to provide undue glare. Similarly, the secondary upper angle $\beta_U$ for the secondary light beam 34 is also configured to avoid undue glare; however, the primary upper angle $\alpha_U$ and the secondary upper angle $\beta_U$ may be the same or different, depending on the lighting requirements and designer choice.

TABLE I

| Distribution | | Secondary Mounting Height Ratio | Primary Upper Angle (°) | Primary Lower Angle (°) | Secondary Upper Angle (°) | Secondary Lower Angle (°) |
|---|---|---|---|---|---|---|
| Lateral | Vertical | $(h_s/h_p)$ | $\alpha_U$ | $\alpha_L$ | $\beta_U$ | $\beta_L$ |
| Type I | Short | 0.625 | 70 | 49 | 60 | 0 |
| Type II | Short | 0.525 | 70 | 44 | 60 | 0 |
| Type II | Medium | 0.625 | 80 | 49 | 60 | 0 |
| Type III | Medium | 0.65 | 80 | 50 | 60 | 0 |
| Type IV | Medium | 0.65 | 80 | 50 | 60 | 0 |
| Type V | Medium | 0.6 | 80 | 48 | 60 | 0 |

For LED based luminaires 20, the size of each of the primary and secondary light sources 24, 28 may generally correspond to the amount of light each emits. As the primary mounting high $h_p$ remains constant, the most effective way to reduce the moment caused by the primary light source 24 is to reduce the mass of the primary light source 24. To reduce the mass of the primary light source 24, the secondary light source 28 may be used to distribute light to a larger secondary coverage area 38, and the primary light source 24 may be used to distribute light to a smaller primary coverage area 36. As such, the light output and mass of the primary light source 24, which is mounted high on the pole 22, is decreased while the light output of the of secondary light source 28, which is mounted lower on the pole 22, is increased.

Without increasing the height of the pole 22, increasing the secondary coverage area 38 corresponds to increasing the secondary upper angle $\beta_U$, which should be constrained based on the desired maximum glare cutoff angle and the required lateral and vertical distribution types. In one embodiment set forth in Table I, the maximum glare cutoff angle is 60° for the secondary light source 28.

Table II below provides exemplary moment reductions relative to a conventional luminaire 10. The table shows the relative moment reductions for both 60° and 70° secondary upper angles $\beta_U$ for the secondary light source 28. As expected, the greater secondary upper angle $\beta_U$ corresponds to greater moment reductions. This is because the greater secondary upper angle $\beta_U$ corresponds to a greater secondary coverage area 38, and thus, a greater shift in lumen output from the primary light source 24 to the secondary light source 28, assuming the overall output of the luminaire 20 (combination of the primary and secondary light sources 24, 28) remains constant.

TABLE II

| Distribution | | Secondary Mounting Height | % Moment Reduction (60° Secondary | % Moment Reduction (70° Secondary |
|---|---|---|---|---|
| Lateral | Vertical | Ratio $(h_s/h_p)$ | Upper Angle $\beta_U$) | Upper Angle $\beta_U$) |
| Type I | Short | 0.625 | 21 | 45 |
| Type II | Short | 0.525 | 24 | 44 |
| Type II | Medium | 0.625 | 15 | 31 |
| Type III | Medium | 0.65 | 14 | 29 |
| Type IV | Medium | 0.65 | 14 | 29 |
| Type V | Medium | 0.6 | 13 | 25 |

Tables III and IV below provide further configurations for a luminaire 20. In particular, the secondary mounting height ratios are provided as a range, wherein the ratio of the secondary mounting height $h_s$ relative to the primary mounting height $h_p$ $(h_s/h_p)$ ranges between about 0.45 and 0.9. Table IV illustrates the relative moment reduction for a secondary upper angle $\beta_U$ of 60°.

While the respective mounting heights may vary based on any number of variables, some exemplary ranges include the secondary mounting height being between about 0.45 and 0.90; 0.6 and 0.65; or 0.45 and 0.65 times the primary mounting height. In another example, the primary upper angle associated with the primary light beam is between about 65° and 85°; the secondary upper angle associated with the secondary light beam is between about 55° and 65°; and the secondary lower angle associated with the secondary light beam is about 0°. A primary lower angle associated with the primary light beam may be between about 45° and 65°.

TABLE III

| Distribution | | | Secondary Mounting Height | Primary Upper Angle (°) | Primary Lower Angle (°) | Secondary Upper Angle (°) | Secondary Lower Angle (°) |
|---|---|---|---|---|---|---|---|
| Lateral | Vertical | Range | Ratio $(h_s/h_p)$ | $\alpha_U$ | $\alpha_L$ | $\beta_U$ | $\beta_L$ |
| Type I | Short | UPPER | 0.9 | 70 | 58 | 60 | 0 |
| | | LOWER | 0.45 | 70 | 39 | 60 | 0 |
| Type II | Short | UPPER | 0.9 | 70 | 57 | 60 | 0 |
| | | LOWER | 0.45 | 70 | 39 | 60 | 0 |
| Type II | Medium | UPPER | 0.9 | 80 | 58 | 60 | 0 |
| | | LOWER | 0.45 | 80 | 39 | 60 | 0 |
| Type III | Medium | UPPER | 0.9 | 80 | 58 | 60 | 0 |
| | | LOWER | 0.45 | 80 | 39 | 60 | 0 |
| Type IV | Medium | UPPER | 0.9 | 80 | 58 | 60 | 0 |
| | | LOWER | 0.45 | 80 | 39 | 60 | 0 |
| Type V | Medium | UPPER | 0.9 | 80 | 58 | 60 | 0 |
| | | LOWER | 0.45 | 80 | 39 | 60 | 0 |

TABLE IV

| Distribution | | | % Moment Reduction (60° Secondary Upper |
|---|---|---|---|
| Lateral | Vertical | Range | Angle $\beta_U$) |
| Type I | Short | UPPER | 10 |
| | | LOWER | 16 |
| Type II | Short | UPPER | 12 |
| | | LOWER | 18 |
| Type II | Medium | UPPER | 10 |
| | | LOWER | 7 |
| Type III | Medium | UPPER | 7 |
| | | LOWER | 8 |
| Type IV | Medium | UPPER | 7 |
| | | LOWER | 10 |
| Type V | Medium | UPPER | 6 |
| | | LOWER | 11 |

As noted, the primary and secondary light sources 24, 28 are LED-based light sources that employ an array of LEDs. What follows in association with FIGS. 6A and 6B is a basic description of two exemplary LEDs 42 and a detailed description of the electronics used to drive an array of LEDs.

A traditional package for an LED 42 of the array of LEDs is illustrated in FIG. 6A. A single LED chip 44 is mounted on a reflective cup 46 using solder or a conductive epoxy, such that ohmic contacts for the cathode (or anode) of the LED chip 44 are electrically coupled to the bottom of the reflective cup 46. The reflective cup 46 is either coupled to or integrally formed with a first lead 48 of the LED 42. One or more bond wires 50 connect ohmic contacts for the anode (or cathode) of the LED chip 44 to a second lead 52.

The reflective cup 46 may be filled with an encapsulant material 54 that encapsulates the LED chip 44. The encapsulant material 54 may be clear or may contain a wavelength conversion material, such as a phosphor, which is described in greater detail below. The entire assembly is encapsulated in a clear protective resin 56, which may be molded in the shape of a lens to control the light emitted from the LED chip 44.

An alternative package for an LED 42 is illustrated in FIG. 6B wherein the LED chip 44 is mounted on a substrate 58. In particular, the ohmic contacts for the anode (or cathode) of the LED chip 44 are directly mounted to first contact pads 60 on the surface of the substrate 58. The ohmic contacts for the cathode (or anode) of the LED chip 44 are connected to second contact pads 62, which are also on the surface of the substrate 58, using bond wires 64. The LED chip 44 resides in a cavity of a reflector structure 66, which is formed from a reflective material and functions to reflect light emitted from the LED chip 44 through the opening formed by the reflector structure 66. The cavity formed by the reflector structure 66 may be filled with an encapsulant material 54 that encapsulates the LED chip 44. The encapsulant material 54 may be clear or may contain a wavelength conversion material, such as a phosphor.

In either of the embodiments of FIGS. 6A and 6B, if the encapsulant material 54 is clear, the light emitted by the LED chip 44 passes through the encapsulant material 54 and the protective resin 56 without any substantial shift in color. As such, the light emitted from the LED chip 44 is effectively the light emitted from the LED 42. If the encapsulant material 54 contains a wavelength conversion material, substantially all or a portion of the light emitted by the LED chip 44 in a first wavelength range may be absorbed by the wavelength conversion material, which will responsively emit light in a second wavelength range. The concentration and type of wavelength conversion material will dictate how much of the light emitted by the LED chip 44 is absorbed by the wavelength conversion material as well as the extent of the wavelength conversion. In embodiments where some of the light emitted by the LED chip 44 passes through the wavelength conversion material without being absorbed, the light passing through the wavelength conversion material will mix with the light emitted by the wavelength conversion material. Thus, when a wavelength conversion material is used, the light emitted from the LED 42 is shifted in color from the actual light emitted from the LED chip 44.

The array of LEDs in each of the primary and secondary light sources 24, 28 may include different types of LEDs 42 that emit different colors of light. For example, the array of LEDs may include both red LEDs that emit reddish light and blue-shifted yellow (BSY) LEDs that emit bluish-yellow light or blue-shifted green (BSG) LEDs that emit bluish-green light, wherein the red and bluish-yellow or bluish-green light mixes together to form "white" light at a desired color temperature. In certain embodiments, the array of LEDs may include a large number of red LEDs and BSY or BSG LEDs in various ratios. For example, five or six BSY or BSG LEDs may surround each red LED, and the total number of LEDs may be 25, 50, 100, or more depending on the application and desired lumen output, color temperature, and color rendering capability. While the present disclosure focuses on using red LEDs along with either BSY or BSG LEDs, any combination of colored LEDs, such as red, green, and blue, is acceptable. In alternative embodiments, all of the LEDs in the array may be the same. For example, the array of LEDs may comprise only white LEDs.

For purposes of illustration only, assume that the array of LEDs in each of the primary and secondary light sources 24, 28 may include a group of BSY or BSG LEDs 42 as well as a group of red LEDs 42. BSY LEDs 42 include an LED chip 42 that emits bluish light, and the wavelength conversion material is a yellow phosphor that absorbs the blue light and emits yellowish light. Even if some of the bluish light passes through the phosphor, the resultant mix of light emitted from the overall BSY LED 42 is yellowish light. The yellowish light emitted from a BSY LED 42 has a color point that falls above the Black Body Locus (BBL) on the 1931 CIE chromaticity diagram wherein the BBL corresponds to the various color temperatures of white light.

Similarly, BSG LEDs 42 include an LED chip 44 that emits bluish light; however, the wavelength conversion material is a greenish phosphor that absorbs the blue light and emits greenish light. Even if some of the bluish light passes through the phosphor, the resultant mix of light emitted from the overall BSG LED 42 is greenish light. The greenish light emitted from a BSG LED 42 has a color point that falls above the BBL on the 1931 CIE chromaticity diagram wherein the BBL corresponds to the various color temperatures of white light.

The red LEDs 42 generally emit reddish light at a color point on the opposite side of the BBL as the yellowish or greenish light of the BSY or BSG LEDs 42. As such, the reddish light from the red LEDs 42 mixes with the yellowish or greenish light emitted from the BSY or BSG LEDs 42 to generate white light that has a desired color temperature and falls within a desired proximity of the BBL. In effect, the reddish light from the red LEDs 42 pulls the yellowish or greenish light from the BSY or BSG LEDs 42 to a desired color point on or near the BBL. Notably, the red LEDs 42 may have LED chips 44 that natively emit reddish light wherein no wavelength conversion material is employed. Alternatively, the LED chips 44 may be associated with a wavelength conversion material, wherein the resultant light emitted from the wavelength conversion material and any light that is emitted from the LED chips 44 without being absorbed by the wavelength conversion material mixes to form the desired reddish light.

The blue LED chip 44 used to form either the BSY or BSG LEDs 42 may be formed from a gallium nitride (GaN), indium gallium nitride (InGaN), silicon carbide (SiC), zinc selenide (ZnSe), or like material system. The red LED chip 44 may be formed from an aluminum indium gallium nitride (AlInGaP), gallium phosphide (GaP), aluminum gallium arsenide (AlGaAs), or like material system. Exemplary yellow phosphors include cerium-doped yttrium aluminum garnet (YAG:Ce), yellow BOSE (Ba, O, Sr, Si, Eu) phosphors, and the like. Exemplary green phosphors include green BOSE phosphors, Lutetium aluminum garnet (LuAg), cerium doped LuAg (LuAg:Ce), Maui M535 from Lightscape Materials, Inc. of 201 Washington Road, Princeton, N.J. 08540, and the like. The above LED architectures, phosphors, and material systems are merely exemplary and are not intended to provide an exhaustive listing of architectures, phosphors, and materials systems that are applicable to the concepts disclosed herein.

The basic electronics for driving an array of LEDs 80 is illustrated in FIG. 7 according to one embodiment of the disclosure. The array of LEDs 80 is electrically divided into two or more strings of series-connected LEDs 42. There are three LED strings S1, S2, and S3 depicted; however, any number of strings may be used. For clarity, the reference number "42" will include a subscript indicative of the color of the LED 42 in the following text, where 'R' corresponds to red, BSY corresponds to blue-shifted yellow, BSG corresponds to blue-shifted green, and BSX corresponds to either BSG or BSY LEDs. LED string 51 includes a number of red LEDs $\mathbf{42}_R$, LED string S2 includes a number of either BSY or BSG LEDs $\mathbf{42}_{BSX}$, and LED string S3 also includes a number of either BSY or BSG LEDs $\mathbf{42}_{BSX}$. The electronics provide any necessary power conversions and function to control the current delivered to the respective LED strings S1, S2, and S3. The current used to drive the LEDs 42 is generally pulse width modulated (PWM), wherein the duty cycle of the pulsed current controls the intensity of the light emitted from the LEDs 42.

The BSY or BSG LEDs $\mathbf{42}_{BSX}$ in the second LED string S2 may be selected to have a slightly more bluish hue (less yellowish or greenish hue) than the BSY or BSG LEDs $\mathbf{42}_{BSX}$ in the third LED string S3. As such, the current flowing through the second and third strings S2 and S3 may be tuned to control the yellowish or greenish light that is effectively emitted by the BSY or BSG LEDs $\mathbf{42}_{BSX}$ of the second and third LED strings S2, S3. By controlling the relative intensities of the yellowish or greenish light emitted from the differently hued BSY or BSG LEDs $\mathbf{42}_{BSX}$ of the second and third LED strings S2, S3, the hue of the combined yellowish or greenish light from the second and third LED strings S2, S3 may be controlled in a desired fashion.

The ratio of current provided through the red LEDs $\mathbf{42}_R$ of the first LED string S1 relative to the currents provided through the BSY or BSG LEDs $\mathbf{42}_{BSX}$ of the second and third LED strings S2 and S3 may be adjusted to effectively control the relative intensities of the reddish light emitted from the red LEDs $\mathbf{42}_R$ and the combined yellowish or greenish light emitted from the various BSY or BSG LEDs $\mathbf{42}_{BSX}$. As such, the intensity and the color point of the yellowish or greenish light from BSY or BSG LEDs $\mathbf{42}_{BSX}$ can be set relative the intensity of the reddish light emitted from the red LEDs $\mathbf{42}_R$. The resultant yellowish or greenish light mixes with the reddish light to generate white light that has a desired color temperature and falls within a desired proximity of the BBL.

The electronics depicted in FIG. 7 generally include AC-DC circuitry 68 and DC-DC circuitry 70, which includes conversion circuitry 72, and current control circuitry 74. The AC-DC circuitry 68 is adapted to receive an AC power signal (AC IN), rectify the AC power signal, and correct the power factor of the AC power signal. The resultant rectified AC power signal is provided to the conversion circuitry 72, which converts the rectified AC power signal to a DC signal. The DC signal may be boosted or bucked to one or more desired DC voltages by DC-DC converter circuitry, which is provided by the conversion circuitry 72. The resultant DC signal is provided to the first end of each of the LED strings S1, S2, and S3 at a desired voltage. The conversion circuitry 72 may also provide a DC signal at the same or different DC voltage to power the current control circuitry 74.

In this example, the current control circuitry 74 is coupled to the second end of each of the LED strings S1, S2, and S3. Based on any number of fixed or dynamic parameters, the current control circuitry 74 may individually control the pulse width modulated current that flows through the respective LED strings S1, S2, and S3 such that the resultant white light emitted from the LED strings S1, S2, and S3 has a desired color temperature and falls within a desired proximity of the BBL.

In certain instances, a dimming device provides the AC power signal. The AC-DC circuitry 68 may be configured to detect the relative amount of dimming associated with the AC power signal and provide a corresponding dimming signal to the current control circuitry 74. Based on the dimming signal, the current control circuitry 74 will adjust the current provided to each of the LED strings S1, S2, and S3 to effectively reduce the intensity of the resultant white light emitted from the LED strings S1, S2, and S3 while maintaining the desired color temperature.

The intensity or color of the light emitted from the LEDs 42 may be affected by ambient temperature. If associated with a thermistor 76 or other temperature sensing device, the current control circuitry 74 can control the current provided to each of the LED strings S1, S2, and S3 based on ambient temperature in an effort to compensate for adverse temperature effects. The intensity or color of the light emitted from the LEDs 42 may also change over time. If associated with an optical sensor 78, the current control circuitry 74 can measure the color of the resultant white light being generated by the LED strings S1, S2, and S3 and adjust the current provided to each of the LED strings S1, S2, and S3 to ensure that the resultant white light maintains a desired color temperature. The same or different optical sensor 78 may also be used to detect ambient light, the presence or absence of which may be used to turn on or off the primary and secondary light sources 24, 28 in dusk-to-dawn applications or the like.

As illustrated in FIG. 8A, each of the primary and secondary light sources 24, 28 may have a housing that includes AC-DC circuitry 68, DC-DC circuitry 70, and an array of LEDs 80. In particular, the primary light source 24 will include AC-DC circuitry $\mathbf{68}_P$, DC-DC circuitry $\mathbf{70}_P$, and an array of LEDs $\mathbf{80}_P$, which function as described above. Similarly, the secondary light source 28 will include AC-DC circuitry $\mathbf{68}_S$, DC-DC circuitry $\mathbf{70}_S$, and an array of LEDs $\mathbf{80}_S$. Power is supplied through appropriate cabling 82 that is routed through the interior of the pole 22 and the respective primary and secondary mounting arms 26, 30.

The respective primary and secondary light sources 24, 28 may operate independently of one another. Alternatively, the primary and secondary light sources 24, 28 may operate in a master-slave arrangement, wherein one of the primary or secondary light sources 24, 28 effectively controls the other of the primary or secondary light sources 24, 28. For example, the secondary light source 28 may make the decisions as to when both of the primary and secondary light sources 24, 28 turn on or turn off, as well as set any dimming levels, if such is necessary. Communications between the primary and secondary light sources 24, 28 in this embodiment may be provided through the cabling 82, through an appropriate communication bus, or wirelessly, if both of the DC-DC circuitries $\mathbf{70}_P$ and $\mathbf{70}_S$ are equipped with wireless communication capabilities.

As illustrated in FIG. 8B, the AC-DC circuitry 68 may be located at a remote location, such as at the base of the pole 22, and used to serve both of the primary and secondary light sources 24, 28. Providing the AC-DC circuitry 68 at a remote location from the primary and secondary light sources 24, 28 helps reduce the mass of the respective light sources 24, 28.

To further reduce the mass of the primary and secondary light sources 24, 28, the DC-DC circuitry 70 may also be provided in a remote location with the AC-DC circuitry, as shown in FIG. 8C. In such an embodiment, the current control circuitry of the 74 of the DC-DC circuitry 70 may provide the same or different drive signals to the respective arrays of LEDs $\mathbf{80}_P$, $\mathbf{80}_S$ of the primary and secondary light sources 24, 28. Providing the AC-DC circuitry 68 and the DC-DC circuitry 70 at a remote location from the primary and secondary light sources 24, 28 helps to further reduce the mass of the respective light sources 24, 28, which would include primarily the LED arrays $\mathbf{80}_P$, $\mathbf{80}_S$ and a housing.

Alternatively, each of the primary and secondary light sources 24, 28 may be associated with dedicated DC-DC circuitries $\mathbf{70}_P$, $\mathbf{70}_S$, which share a common AC-DC circuitry 68 and are located at the remote location. In yet another embodiment, each of the primary and secondary light sources 24, 28 may also be associated with dedicated AC-DC circuitries $\mathbf{68}_P$, $\mathbf{68}_S$, which are located at the remote location.

As illustrated in FIG. 8D, the primary and secondary light sources 24, 28 may be configured differently with regard to the AC-DC circuitry 68 and DC-DC circuitry 70. For example, the primary light source 24 may primarily include an array of LEDs $\mathbf{80}_P$ and a housing, wherein the secondary light source 28 may include AC-DC circuitry 68, DC-DC circuitry 70, an array of LEDs $\mathbf{80}_S$, and a housing. In this embodiment, the DC-DC circuitry 70, which is located in the secondary light source 28, is used to drive both the arrays of LEDs $\mathbf{80}_S$ of the secondary light source 28 as well as the array of LEDs $\mathbf{80}_P$ for the primary light source 24. As such, the mass that would normally be associated with the AC-DC circuitry 68 and DC-DC circuitry 70 for the primary light source 24 is effectively removed from the upper portion of the luminaire 20. After reading the present disclosure, those skilled in the art will recognize various alternatives to the specific embodiments proposed herein. For example, in yet another embodiment, the primary light source 24 will include DC-DC circuitry $\mathbf{70}_P$ and an array of LEDs $\mathbf{80}_P$, but no AC-DC circuitry $\mathbf{68}_P$. The secondary light source 28 would include AC-DC circuitry 68 shared between the primary and secondary light sources 24, 28, DC-DC circuitry $\mathbf{70}_S$, and an array of LEDs $\mathbf{80}_S$.

Four of an innumerable number of possible configurations for the primary and secondary light sources 24, 28 are shown in FIGS. 9A-9D. In each of these configurations, an array of LEDs 80 is distributed along a portion of the back and/or sides of a reflector 84. A lens 86 is provided opposite the reflector 84, wherein the space between the reflector 84 and the lens 86 forms a mixing chamber. The light emitted from the array of LEDs 80 is effectively mixed in the mixing chamber, and is passed through the lens 86 toward the appropriate primary or secondary coverage area 36, 38.

Figure 9A:
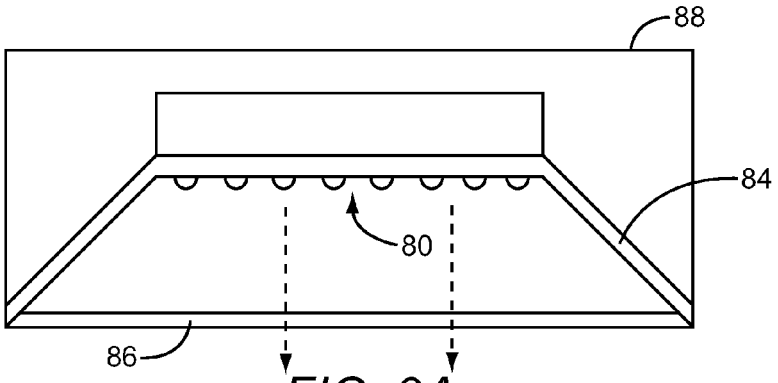
Figure 9B:
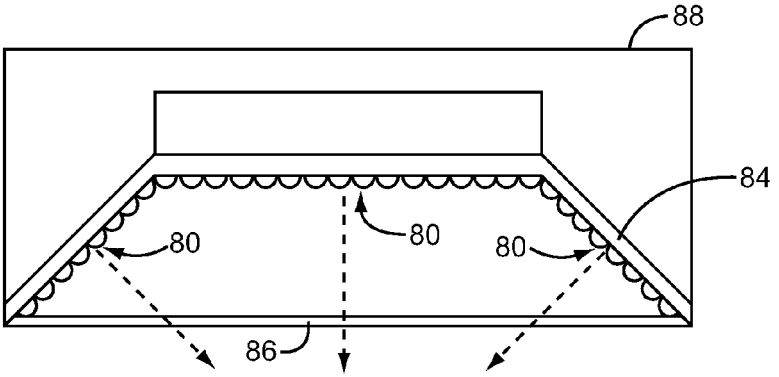
Figure 9C:
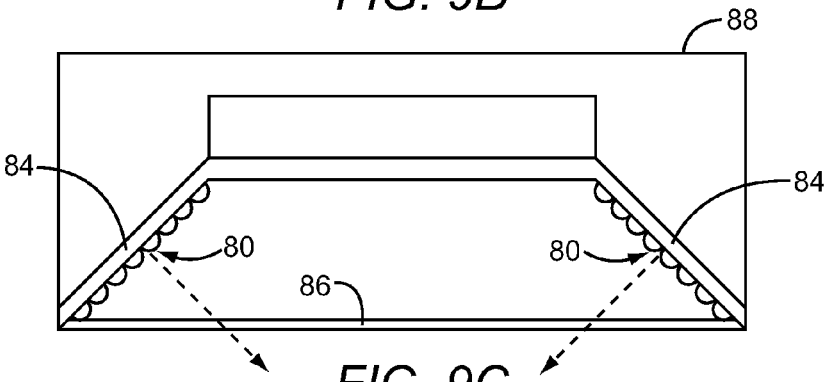
Figure 9D:
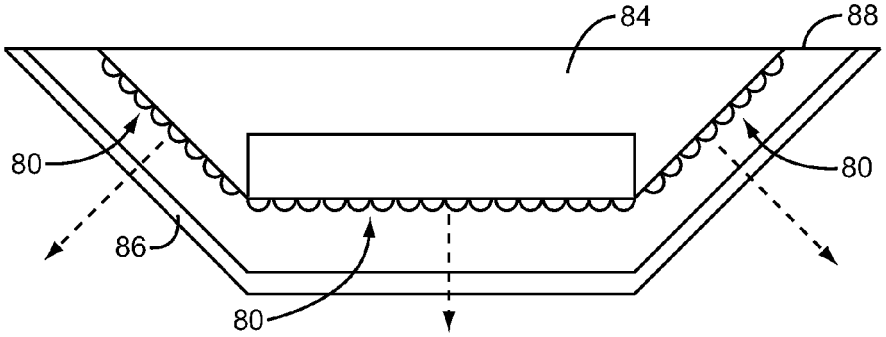

In FIG. 9A, the reflector 84 is conically shaped, and the array of LEDs 80 is placed along the back surface of the reflector 84 or within an opening provided in the back surface of the reflector 84. In FIG. 9B, the array of LEDs 80 resides along the back of the reflector 84 as well as along at least a portion of the sides of the reflector 84. In FIG. 9C, the array of LEDs 80 is only provided on the sides of the reflector 84, wherein the back portion of the reflector 84 is left void of any LEDs 42. FIG. 9D has a reflector 84 that is effectively inverted from those shown in FIGS. 9A-9C, and has an array of LEDs 80 distributed along the front face and sides of the reflector 84. The lens 86 is shown to follow the contour of the reflector 84; however, those skilled in the art will recognize that the shape of the reflector 84, lens 86, and the housing 88 for each of these embodiments may be configured to achieve various functional and aesthetic objectives.

Those skilled in the art will recognize improvements and modifications to the preferred embodiments of the present disclosure. For example, three, four, or more light sources may be mounted on the pole at substantially differing heights and configured to primarily light up correspondingly different portions of a target surface area. As an example, a third light source could be mounted on a pole at an intermediate height between the (upper) primary light source and the (lower) secondary light source. All such improvements and modifications are considered within the scope of the concepts disclosed herein and the claims that follow.

What is claimed is:

1. A luminaire comprising:

a pole;

a first light source mounted at a primary mounting height to the pole where the first light source is configured to project a primary beam of light that primarily lights up a first portion of a target coverage area that is substantially perpendicular to the pole; and a second light source mounted at a secondary mounting height to the pole, wherein the second light source is configured to project a secondary beam of light that primarily lights up a second portion of the target coverage area, which is different from the first target coverage area and the primary mounting height is substantially higher than the secondary mounting height and the first and second light sources are LED-based light sources.

2. The luminaire of claim 1 wherein projected light within a beam angle for the primary beam of light substantially covers the first portion of the target coverage area and projected light within a beam angle for the secondary beam of light substantially covers the second portion of the target coverage area.

3. The luminaire of claim 1 wherein the first portion of the target coverage area is smaller than the secondary portion of the target coverage area.

4. The luminaire of claim 1 wherein the first portion of the target coverage area is substantially the same size as the secondary portion of the target coverage area.

5. The luminaire of claim 1 wherein the first portion of the target coverage area is larger than the secondary portion of the target coverage area.

6. The luminaire of claim 1 wherein the secondary mounting height is between about 0.45 and 0.90 times the primary mounting height.

7. The luminaire of claim 1 wherein the secondary mounting height is between about 0.6 and 0.65 times the primary mounting height.

8. The luminaire of claim 1 wherein the secondary mounting height is between about 0.45 and 0.65 times the primary mounting height.

9. The luminaire of claim 1 wherein the primary beam of light and the secondary beam of light combine to provide at least one of a Type I, Type II, Type III, Type IV, and Type V Illuminating Engineering Society of North America (IESNA) outdoor lighting lateral distribution.

10. The luminaire of claim 1 wherein the primary beam of light and the secondary beam of light combine to provide at least one of a Short, Medium, and Long Illuminating Engineering Society of North America (IESNA) outdoor lighting vertical distribution.

11. The luminaire of claim 1 wherein a primary upper angle associated with the primary light beam is between about 65° and 85°.

12. The luminaire of claim 11 wherein a secondary upper angle associated with the secondary light beam is between about 55° and 65°.

13. The luminaire of claim 12 wherein a secondary lower angle associated with the secondary light beam is about 0°.

14. The luminaire of claim 12 wherein a primary lower angle associated with the primary light beam is between about 45° and 65°.

15. The luminaire of claim 11 wherein a primary lower angle associated with the primary light beam is between about 45° and 65°.

16. The luminaire of claim 1 wherein the luminaire is an outdoor luminaire.

17. A luminaire comprising:

a pole;

a first light source mounted at a primary mounting height to the pole where the first light source comprises primary AC-DC circuitry adapted to at least rectify an AC input signal to provide a primary signal, primary DC-DC circuitry adapted to receive the primary signal and provide at least one primary drive signal, and a primary array of LEDs adapted to provide a primary beam of light in response to the at least one primary drive signal; and a second light source mounted at a secondary mounting height to the pole, wherein the second light source comprises secondary AC-DC circuitry adapted to at least rectify the AC input signal to provide a secondary signal, secondary DC-DC circuitry adapted to receive the secondary signal and provide at least one secondary drive signal, and a secondary array of LEDs adapted to provide a secondary beam of light in response to the at least one secondary drive signal where the primary mounting height is higher than the secondary mounting height and the first and second light sources are LED-based light sources.

18. A luminaire comprising:

a pole;

a first light source mounted at a primary mounting height to the pole;

a second light source mounted at a secondary mounting height to the pole, wherein the primary mounting height is higher than the secondary mounting height and the first and second light sources are LED-based light sources;

AC-DC circuitry that is adapted to at least rectify an AC input signal to provide a primary signal and a secondary signal, the AC-DC circuitry remotely located from the first light source and the second light source, wherein:

the first light source comprises primary DC-DC circuitry adapted to receive the primary signal and provide at least one primary drive signal, and a primary array of LEDs adapted to provide a primary beam of light in response to the at least one primary drive signal; and the second light source comprises secondary DC-DC circuitry adapted to receive the secondary signal and provide at least one secondary drive signal, and a secondary array of LEDs adapted to provide a secondary beam of light in response to the at least one secondary drive signal.

19. The luminaire of claim 18 wherein the AC-DC circuitry is mounted at or near a base of the pole.

20. The luminaire of claim 18 wherein the AC-DC circuitry is mounted at a height below the secondary mounting height.

21. A luminaire comprising:

a pole;

a first light source mounted at a primary mounting height to the pole;

a second light source mounted at a secondary mounting height to the pole, wherein the primary mounting height is higher than the secondary mounting height and the first and second light sources are LED-based light sources;

AC-DC circuitry that is adapted to at least rectify an AC input signal to provide a first signal; and DC-DC circuitry adapted to receive the first signal and provide at least one primary drive signal and at least one secondary drive signal wherein:

the first light source comprises a primary array of LEDs adapted to provide a primary beam of light in response to the at least one primary drive signal; and the second light source comprises a secondary array of LEDs adapted to provide the secondary beam of light in response to the at least one secondary drive signal, wherein the AC-DC circuitry and the DC-DC circuitry are remotely located from the first light source and the second light source.

22. The luminaire of claim 21 wherein the AC-DC circuitry and the DC-DC circuitry are mounted at or near a base of the pole.

23. The luminaire of claim 21 wherein the AC-DC circuitry and the DC-DC circuitry are mounted at a height below the secondary mounting height.

24. A luminaire comprising:

a pole;

a first light source mounted at a primary mounting height to the pole where the first light source comprises primary DC-DC circuitry adapted to receive a first signal and provide at least one primary drive signal, and a primary array of LEDs adapted to provide a primary beam of light in response to the at least one primary drive signal; and a second light source mounted at a secondary mounting height to the pole, wherein the second light source comprises secondary AC-DC circuitry adapted to at least rectify an AC input signal to provide the first signal, secondary DC-DC circuitry adapted to receive the first signal and provide at least one secondary drive signal, and a secondary array of LEDs adapted to provide a secondary beam of light in response to the at least one secondary drive signal where the primary mounting height is higher than the secondary mounting height and the first and second light sources are LED-based light sources.

25. A kit of light sources for mounting on a pole to form a luminaire comprising:

a first light source to be mounted to the pole at a primary mounting height where the first light source is configured to project a primary beam of light that primarily lights up a first portion of a target coverage area that is substantially perpendicular to the pole; and a second light source to be mounted to the pole at a secondary mounting height and the first and second light sources are LED-based light sources where the second light source is configured to project a secondary beam of light that primarily lights up a second portion of the target coverage area, which is different from the first target coverage area, wherein the primary mounting height is substantially higher than the secondary mounting height and the first and second light sources are LED-based light sources.

26. The kit of claim 25 wherein projected light within a beam angle for the primary beam of light substantially covers the first portion of the target coverage area and projected light within a beam angle for the secondary beam of light substantially covers the second portion of the target coverage area.

27. The kit of claim 25 wherein the first portion of the target coverage area is smaller than the secondary portion of the target coverage area.

* * * * *